US008899985B2

(12) United States Patent
Walls

(10) Patent No.: US 8,899,985 B2
(45) Date of Patent: Dec. 2, 2014

(54) MAGAZINE FOR SIMULATED TETHERLESS PISTOLS WITH LOCKBACK

(71) Applicant: Cubic Corporation, San Francisco, CA (US)

(72) Inventor: Thomas Walls, Orlando, FL (US)

(73) Assignee: Cubic Corporation, San Diego, CA (US)

( * ) Notice: Subject to any disclaimer, the term of this patent is extended or adjusted under 35 U.S.C. 154(b) by 12 days.

(21) Appl. No.: 13/660,764

(22) Filed: Oct. 25, 2012

(65) Prior Publication Data

US 2013/0108991 A1 May 2, 2013

Related U.S. Application Data

(60) Provisional application No. 61/554,431, filed on Nov. 1, 2011.

(51) Int. Cl.

| | |
|---|---|
| ***F41A 19/01*** | (2006.01) |
| ***F41B 11/56*** | (2013.01) |
| ***F41B 11/62*** | (2013.01) |
| ***F41A 17/40*** | (2006.01) |
| ***F41A 3/68*** | (2006.01) |
| ***F41A 17/36*** | (2006.01) |

(52) U.S. Cl.

CPC . *F41A 17/40* (2013.01); *F41A 3/68* (2013.01); *F41A 17/36* (2013.01); *F41A 19/01* (2013.01); *F41B 11/56* (2013.01); *F41B 11/62* (2013.01)

USPC ..... 434/24; 446/473

(58) Field of Classification Search

USPC ..... 434/16, 18, 19, 21, 24; 446/473

See application file for complete search history.

(56) References Cited

U.S. PATENT DOCUMENTS

| | | | | |
|---|---|---|---|---|
| 1,563,675 | A | 12/1925 | Tansley | |
| 1,975,529 | A * | 10/1934 | Anderson | 192/139 |
| 4,265,161 | A * | 5/1981 | Beretta | 89/129.02 |
| 4,450,751 | A * | 5/1984 | Thevis | 89/129.02 |
| 8,602,784 | B2 * | 12/2013 | Dvorak | 434/18 |
| 8,602,785 | B2 * | 12/2013 | Jensen et al. | 434/18 |
| 2005/0034596 | A1 | 2/2005 | Fleming et al. | |
| 2010/0154763 | A1 | 6/2010 | Su | |

FOREIGN PATENT DOCUMENTS

DE 655334 C * 1/1938

OTHER PUBLICATIONS

International Search Report and Written Opinion of PCT/US2012/062684 mailed on Jan. 17, 2013, 64 pages.

International Preliminary Report on Patentability from PCT/US2012/062684, mailed on May 15, 2014, 2 pages.

* cited by examiner

*Primary Examiner* — Sam Yao
*Assistant Examiner* — Jennifer L Fassett
(74) *Attorney, Agent, or Firm* — Kilpatrick Townsend & Stockton LLP

(57) ABSTRACT

A simulated weapon includes a mechanical counting mechanism that incrementally advances upon firing of a simulated round. When the mechanical counting mechanism reaches a state indicating that all simulated rounds have been fired, a slide of the weapon is locked back, mimicking the lockback feature of an actual weapon. The simulated weapon may be untethered, enabling realistic training in weapon handling. The mechanical counting mechanism may be actuated by motion of the slide.

20 Claims, 7 Drawing Sheets

MAGAZINE FOR SIMULATED TETHERLESS PISTOLS WITH LOCKBACK

CROSS-REFERENCES TO RELATED APPLICATION

This application claims priority to U.S. Provisional Patent Application No. 61/554,431, filed Nov. 1, 2011 and titled "Magazine for Simulated Tetherless Pistols With Lockback", the entire disclosure of which is hereby incorporated by reference herein for all purposes.

BACKGROUND OF THE INVENTION

In military of training, it is desirable that simulate battle scenarios be a realistic as possible. Often, simulated weapons are used in training exercises. The simulated weapons are designed to look, feel, and operate much like actual weapons, but for reasons of safety, economy, and data gathering, do not fire live ammunition. Rather, the sound, recoil effect, and other aspects of an actual weapon are simulated. Similar training may be used by law enforcement, private security, government agencies, and the like.

Besides simulating the mechanical aspects of an actual weapon, a simulated weapon may include electronic components that allow measurement of the user's performance. For example, a simulated weapon may include an infrared laser that projects a beam in the direction in which the simulated weapon is aimed whenever the simulated weapon is "fired". Information may be coded into the beam, for example an identifier of the simulated weapon from which the beam emanated. The simulated weapon may also include a wireless communication interface that sends information to a central computer system, including an indication of each firing of the simulated weapon. Sensors at the targets can report when they receive "hits" from simulated fire, and may report the identity of the weapon that scored each hit.

Previous simulated weapons have not been able to simulate some features of actual weapons in a realistic manner. For example, some simulated weapons require a tether to a source of power for operating the weapon. A tethered weapon is unrealistic, and does not allow the user to move as he or she might in an actual combat situation. Furthermore, a tethered weapon may not be able to function without the control of an external computer system. In other cases, simulated weapons have simply omitted features of actual weapons that are difficult to simulate.

There is a need for more realistic simulation of actual weapons.

BRIEF SUMMARY OF THE INVENTION

According to one aspect, a magazine for a simulated pistol includes a mechanical counting mechanism that incrementally advances upon a firing of the simulated pistol, and a lockback element that is actuated by the mechanical counting mechanism when the mechanical counting mechanism reaches a state indicating that all simulated rounds have been fired from the simulated pistol. In some embodiments, the lockback element is a lockback plunger that is released when the mechanical counting mechanism reaches the state indicating that all simulated rounds have been fired from the simulated pistol. The mechanical counting mechanism may include a dual pawl counting mechanism. Advancement of the mechanical counting mechanism may be driven from the recoil of a slide of the simulated pistol. In some embodiments, the magazine further includes an actuation rod driven directly or indirectly by a ramp in the slide of the simulated pistol to actuate the mechanical counting mechanism. In some embodiments, the magazine further includes a reservoir holding a pressurized propellant that provides energy for operating the simulated pistol. The reservoir may hold carbon dioxide at sufficient pressure to liquefy the carbon dioxide. In some embodiments, the reservoir holds sufficient propellant to fire at least 30 simulated rounds from the simulated pistol. In some embodiments, the reservoir holds sufficient propellant to fire at least 50 simulated rounds from the simulated pistol. In some embodiments, the lockback element is a lockback plunger that is released when the mechanical counting mechanism reaches the state indicating that all simulated rounds have been fired from the simulated pistol, the magazine further comprises a locking shaft configured to engage the lockback plunger to hold the lockback plunger within the magazine, and the mechanical counting mechanism further includes a ratchet wheel that incrementally rotates upon each firing of the simulated pistol, and a pin on the ratchet wheel configured to engage the locking shaft and draw the locking shaft out of engagement with the lockback plunger when the counting mechanism reaches the state indicating that all simulated rounds have been fired from the simulated pistol, releasing the lockback plunger. The mechanical counting mechanism may be settable to indicate a number of simulated rounds in the magazine. In some embodiments, the mechanical counting mechanism further includes a ratchet wheel that incrementally rotates upon each firing of the simulated pistol, and the mechanical counting mechanism is settable by rotating the ratchet wheel to a particular rotational position to indicate number of simulated rounds in the magazine. In some embodiments, the lockback element is a lockback plunger that is released when the mechanical counting mechanism reaches the state indicating that all simulated rounds have been fired from the simulated pistol, and the lockback plunger is positioned to actuate a lockback lever of the simulated pistol when the lockback plunger is released.

According to another aspect, a counting mechanism for a magazine of a simulated pistol includes a ratchet wheel, a first pawl that engages the ratchet wheel to incrementally rotate the ratchet wheel upon a firing of the simulated pistol, a second pawl that engages the ratchet wheel to prevent reverse rotation of the ratchet wheel, a pin on the ratchet wheel, and a locking shaft configured to engage a lockback plunger. The pin engages the locking shaft to draw the locking shaft out of engagement with the lockback plunger when the ratchet wheel reaches a state indicating that all simulated rounds have been fired from the simulated pistol. In some embodiments, the counting mechanism further includes a lever to which the first pawl is attached, and an actuation rod that actuates the lever to move the first pawl. The actuation rod may be configured to be driven directly or indirectly from the recoil of a slide of the simulated pistol.

According to another aspect, a simulated weapon includes a slide, a magazine, and a mechanical counting mechanism. The mechanical counting mechanism incrementally advances upon a firing of the simulated pistol, and when the mechanical counting mechanism reaches a state indicating that all simulated rounds have been fired from the simulated weapon, the mechanical counting mechanism causes the slide of the simulated weapon to lock back. The simulated weapon may be a simulated pistol. The simulated weapon may be untethered. The simulated weapon may be made by modifying an actual weapon. In some embodiments, the mechanical counting mechanism is a dual pawl mechanism actuated by motion of the slide.

DETAILED DESCRIPTION OF THE INVENTION

Figure 1:
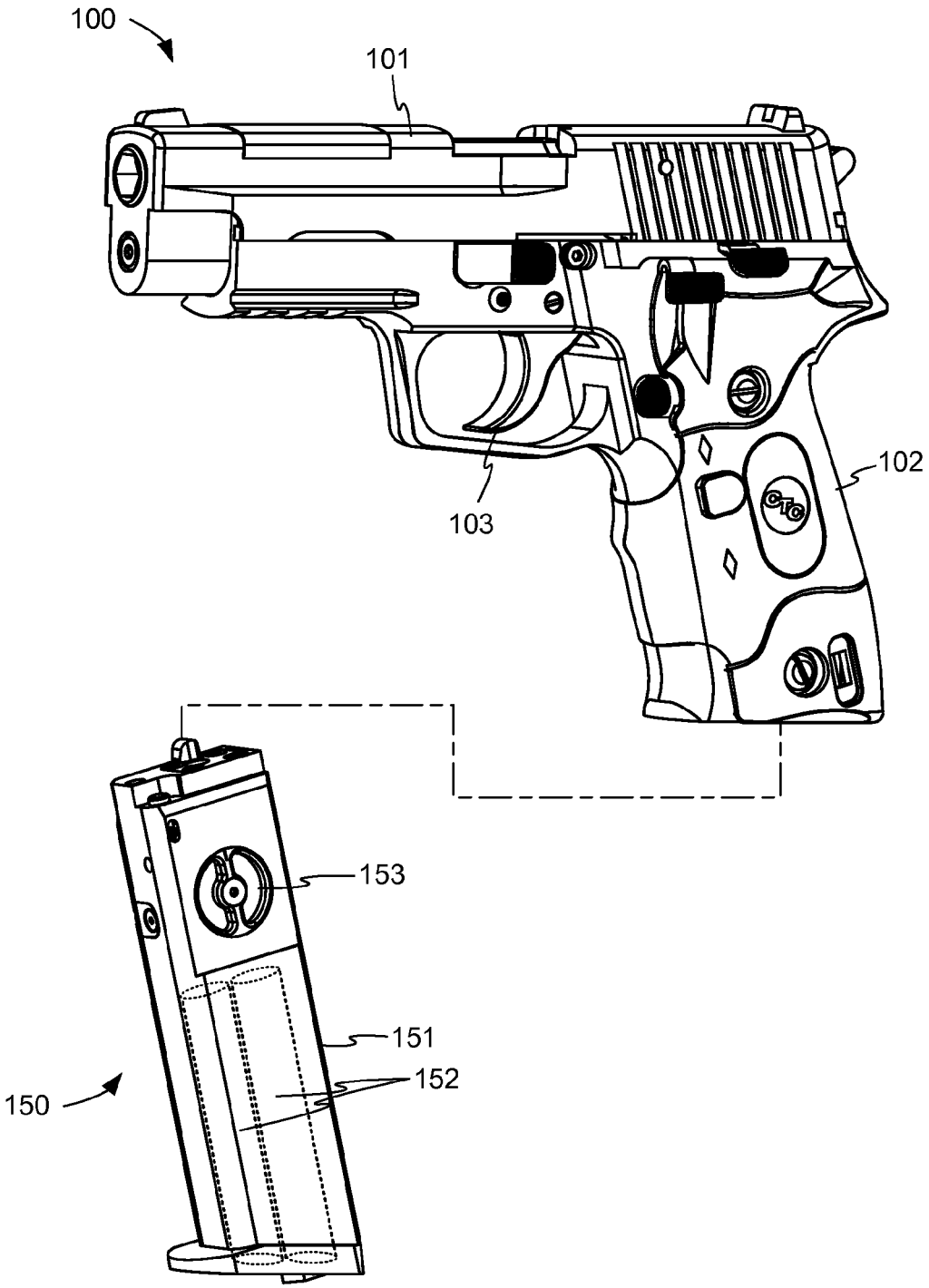
FIG. 1 illustrates a simulated semi-automatic pistol and a magazine for use in the simulated pistol, in accordance with embodiments of the invention.

FIG. 1 illustrates a simulated semi-automatic pistol 100 and a magazine 150 for use in simulated pistol 100, in accordance with embodiments of the invention. Simulated pistol 100 is configured to closely resemble an actual pistol in size, weight, balance, and other factors. In some embodiments, a simulated pistol may be fabricated by modifying an actual pistol to disable it from firing live ammunition, and to add the components required to simulate the operation of the actual pistol and any desired electronic components. A slide 101 forms the upper portion of simulated pistol 100, and the purpose and operation of slide 101 will be discussed in more detail below. Simulated pistol 100 is fired in the usual way, by pulling trigger 103.

Magazine 150 is of the shape and size of an actual magazine and fits within the grip 102 of simulated pistol 100 in the same manner that an actual magazine fits into the grip of an actual pistol. However, magazine 150 does not contain ammunition cartridges. Rather, magazine 150 may contain a pressurized propellant for operating simulated pistol 100, and other components that allow simulation of features of an actual pistol. For example, lower portion 151 of magazine 150 may enclose a reservoir 152 (shown in hidden lines) for holding compressed carbon dioxide to be used as a propellant for operating simulated pistol 100. In some embodiments, carbon dioxide in reservoir 152 is compressed sufficiently to liquefy at room temperature. Dial 153 may be used to set the number of simulated rounds "loaded" into magazine 150, as is described in more detail below.

Figure 2:
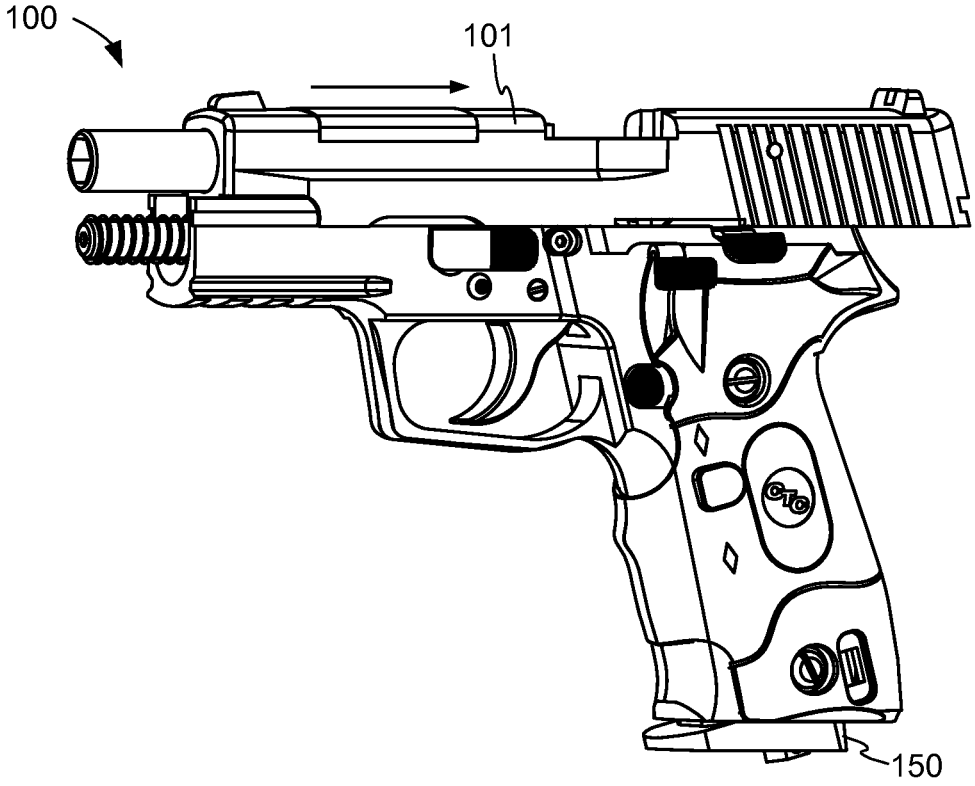
FIG. 2 illustrates the simulated pistol of FIG. 1 with the slide in a recoil position.

FIG. 2 illustrates simulated pistol 100 with slide 101 in a recoil position. That is, slide 101 has moved rearward, toward the user of the pistol. In an actual pistol, the motion of the slide is driven by the firing of a cartridge, and serves several purposes. The rearward motion ejects the casing of the spent cartridge and cocks the weapon for the next shot. The slide is spring loaded, and when additional cartridges are available in the magazine, the slide returns to the position shown in FIG. 1, loading a new cartridge from the magazine in the process.

Typically, upon firing of the last cartridge from an actual pistol, the slide "locks back" in a position similar to that shown in FIG. 2. That is, the slide stays in the rearward position rather than returning to its forward position. This lockback feature serves to signal to the user that the magazine is empty, and facilitates loading the pistol when a new loaded magazine is inserted. When the loaded magazine is inserted and the slide is released, the forward motion of the slide loads the first cartridge from the magazine.

Previous simulated pistols have relied on an electrically-operated solenoid to achieve lockback of the pistol slide. In order to supply the power necessary for the solenoid, the previous simulated pistols have been tethered, or batteries were included in the simulated pistol. A tethered pistol restrains the movements of the trainee, detracting from the simulation experience, and the space consumed by batteries reduces the amount of space available for other aspects of the simulated pistol, for example propellant, and therefore compromises other aspects of the performance of the simulated pistol.

In one aspect, a simulated pistol in accordance with embodiments of the invention is untethered and provides a lockback feature, enabling improved realism for simulation training in pistol handling, marksmanship, and tactics.

Figure 3A:
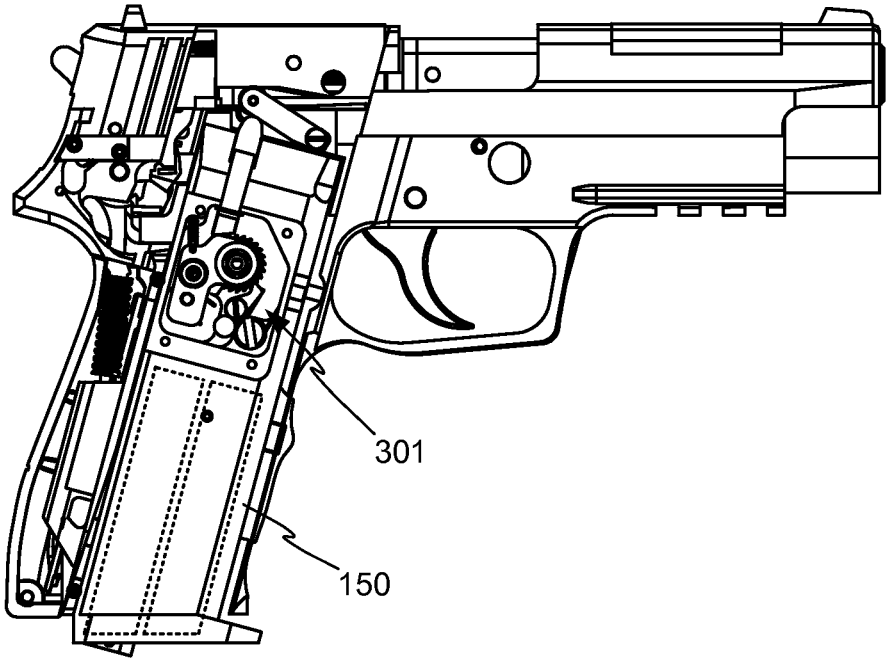
FIG. 3A shows the simulated pistol of FIG. 1 in a partially cutaway view, exposing part of a mechanical counting mechanism included in the magazine, in accordance with embodiments of the invention.

FIG. 3A shows simulated pistol 100 in a partially cutaway view, exposing part of a mechanical counting mechanism 301 included in magazine 150, in accordance with embodiments of the invention. Example counting mechanism 301 is settable to simulate loading magazine 150 with different numbers of rounds. Counting mechanism 301 registers or counts firings of simulated pistol 100, and when the last simulated round has been fired, causes slide 101 to be locked back in the position shown in FIG. 2.

Figure 3B:
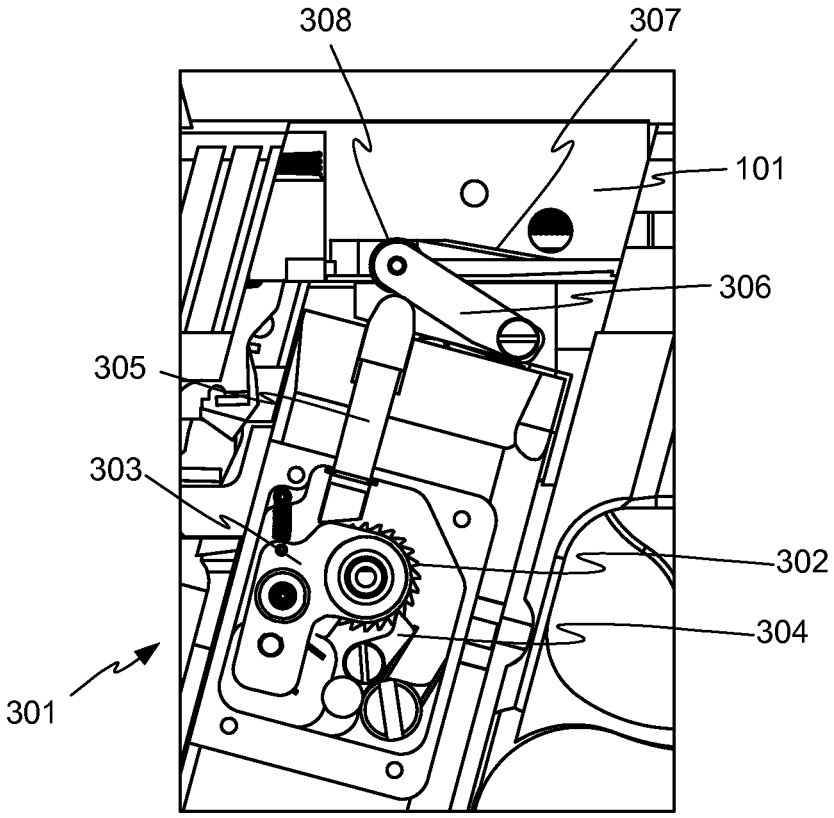
FIG. 3B shows the counting mechanism of FIGS. 3A and 3B in more detail.

FIG. 3B shows example counting mechanism 301 in more detail. A ratchet wheel 302 is incrementally rotated by each firing of simulated pistol 100, and the rotational position of ratchet wheel 302 indicates the number of available rounds. Ratchet wheel 302 is actuated by a first pawl (not visible in FIG. 3A) attached to a pivoting lever 303. A second pawl 304 engages ratchet wheel 302 to prevent reverse motion of ratchet wheel 302. Pivoting lever 303 is actuated by actuation rod 305, which is actuated by an action lever 306. Action lever 306 is actuated by ramp 307 on slide 101 when slide 101 travels backward during recoil. A bearing 308 may be provided to reduce wear between action lever 306 and ramp 307.

Figure 3C:
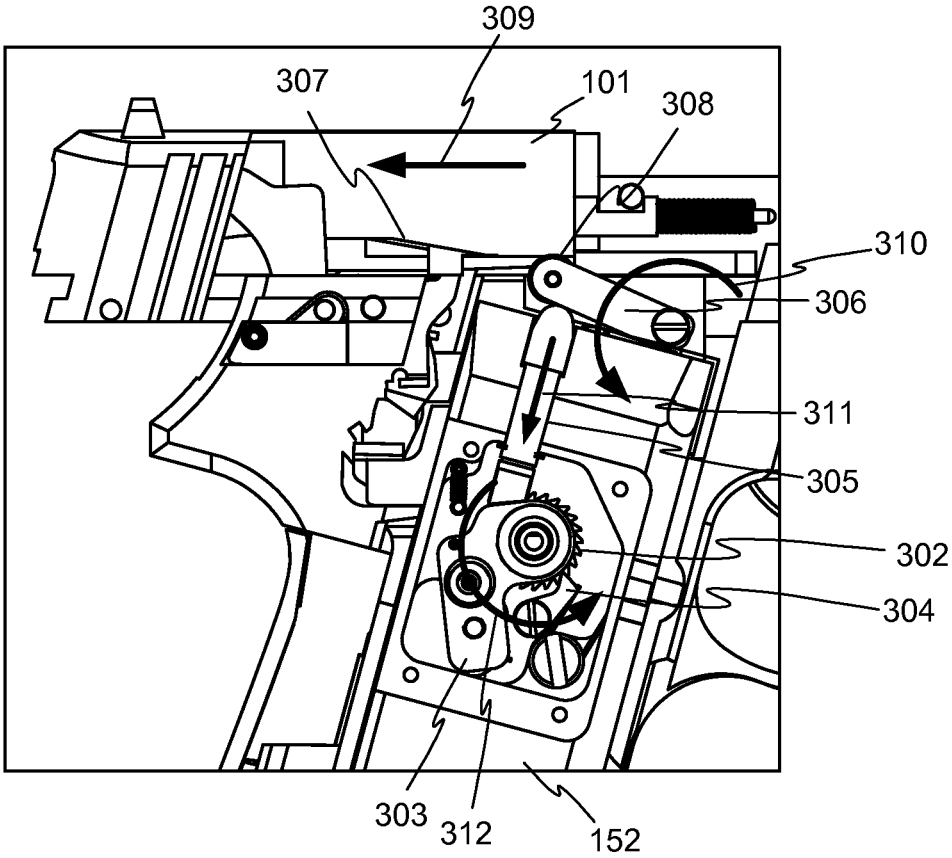
FIG. 3C shows the counting mechanism of FIG. 3B as actuated by recoil of a slide.

FIG. 3C shows counting mechanism 301 as actuated by recoil of slide 101. When simulated pistol 100 is fired, a quantity of propellant is released from reservoir 152 using known means such as a pressure line and one-way valve within magazine 150. The propellant is expelled from simulated pistol 100 to cause recoil similar to that produced by firing an actual pistol, and causing slide 101 to move in rearward direction 309 to its back position, as shown in FIG. 3C. For example, the propellant may act on a piston that is part of a mechanism in simulated pistol 100 in the place of the barrel of an actual pistol. As slide 101 moves rearward, bearing 308 rolls on ramp 307 and the underside of slide 101, causing action lever 306 to rotate in direction 310. During its motion, action lever 306 pushes actuation rod 305 in direction 311. Actuation rod 305 pushes on pivoting lever 303, rotating it in direction 312 and moving the pawl on the hidden side of pivoting lever 303 to turn ratchet wheel 302.

Once the propellant has dissipated, a spring (not visible in FIG. 3C) returns slide 101 to its forward position, cocking the pistol for another shot, if any. When ramp 307 once again passes action lever 306, action lever 306 can return to its original position, allowing actuation rod 305 and pivoting lever 303 to return to their original positions. Pawl 304 prevents reverse motion of ratchet wheel 302, so that one cycle of slide 101 backward and forward increments ratchet wheel 302 by one tooth in direction 312. The sequence is repeated while simulated rounds remain in magazine 150, with ratchet wheel 302 advancing one tooth for each simulated round fired.

Figure 4:
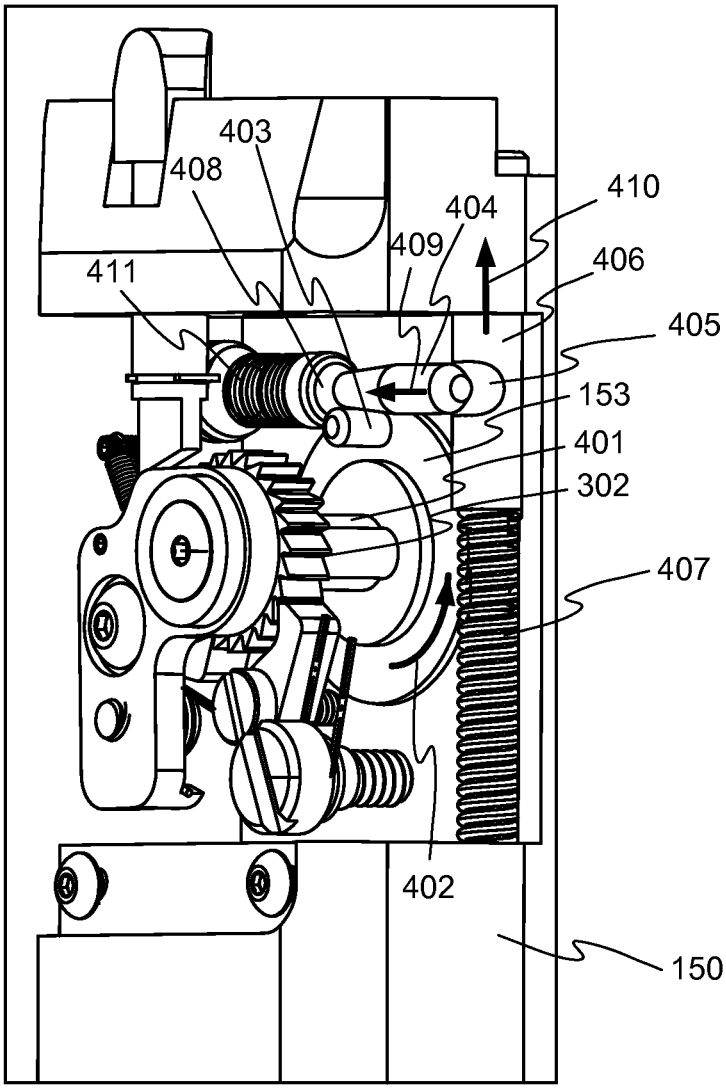
FIG. 4 illustrates a partially cutaway oblique view of the magazine of FIG. 1, showing further operational details of the example mechanical counting mechanism, in accordance with embodiments of the invention.

FIG. 4 illustrates a partially cutaway oblique view of magazine 150, showing further operational details of example mechanical counting mechanism 301, in accordance with embodiments of the invention. In FIG. 4, some of the housing of magazine 150 has been removed to expose additional parts of mechanical counting mechanism 301. Ratchet wheel 302 and dial 153 are coupled together by shaft 401, so that dial 153 incrementally turns in direction 402 as ratchet wheel 302 is incremented by successive firings of simulated pistol 100. A pin 403 pressed fitted or otherwise fixed to dial 153, and turns with dial 153.

While simulated rounds are present in magazine 150, a locking shaft 404 engages a hole or recess 405 in a lockback element in the form of lockback plunger 406. Locking shaft 404 holds lockback plunger 406 in its downward position as shown in FIG. 4, against the force of plunger spring 407, which is in compression and exerts an upward force on lockback plunger 406. When dial 153 has reached the rotational position shown, one more simulated round is available. The next incremental rotation of dial 153 pushes pin 403 against step 408 in locking shaft 404, drawing locking shaft 404 in direction 409 out of recess 405 and releasing lockback plunger 406 to be pushed upward (in direction 410) by plunger spring 407. Locking spring 411 retains locking shaft 404 in recess 405 until it is released by pin 403.

Figure 5A:
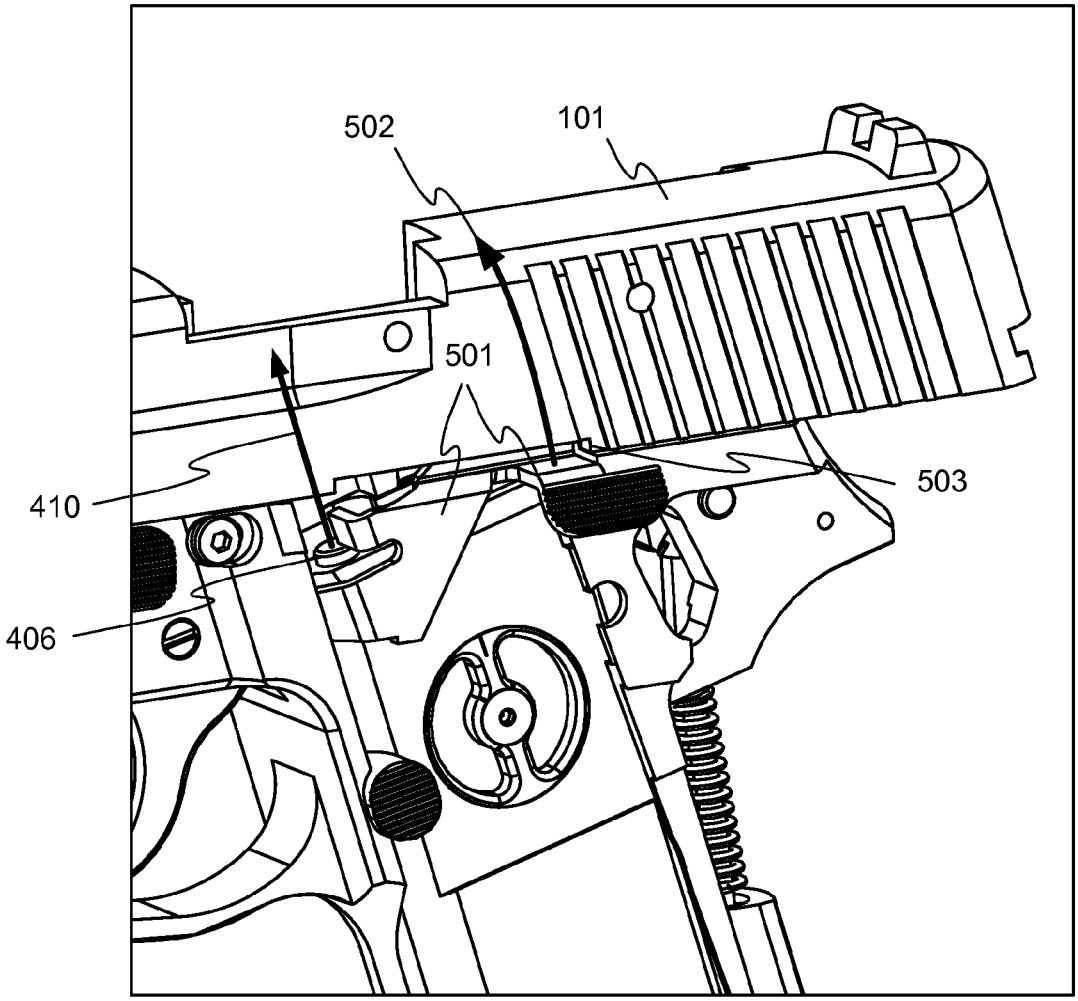
FIG. 5A is a reverse angle oblique cutaway view of part of the simulated pistol of FIG. 1, showing how lockback is completed, in accordance with embodiments of the invention.

FIG. 5A is a reverse angle oblique cutaway view of part of simulated pistol 100, showing how lockback is completed, in accordance with embodiments of the invention. Once released, lockback plunger 406 is urged upward (in direction 410). The top of lockback plunger pushes on lockback lever 501 of simulated pistol 100. Lockback lever 501 is shown in its down position in FIG. 5. Lockback lever 501 is spring loaded to normally remain in the down position, but when driven by lockback plunger 406, lockback lever 501 is driven upward (in direction 502), where it engages the edge of lockback slot 503 of slide 101, preventing slide 101 from moving forward.

Figure 5B:
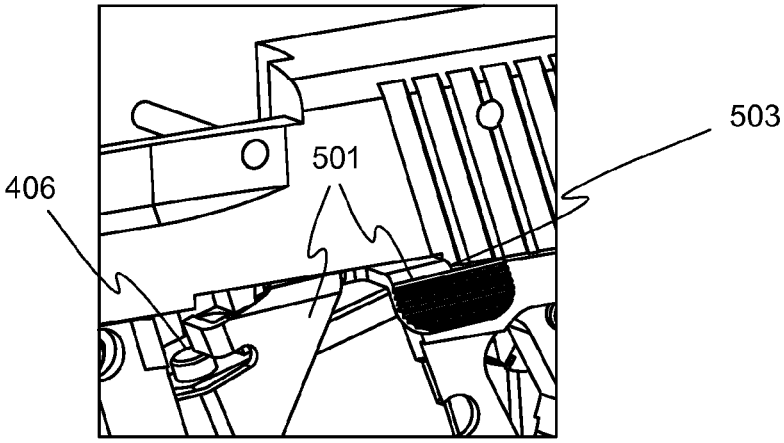
FIG. 5B is a detail view of a portion of the simulated pistol of FIG. 1 in a locked back state.

FIG. 5B is a detail view showing lockback lever 501 in its upward position, in engagement with lockback slot 503. In this example mechanism, the upward force of lockback plunger 406 on lockback lever 501 is initiated just prior to the firing of the last simulated round, when locking shaft 404 is drawn out of recess 405 and before slide 101 retracts. Lockback lever 501 is prevented from moving upward until slide 101 has moved rearward far enough to expose lockback slot 503.

Slide 101 is thus locked back, signaling that no more simulated rounds are available in magazine 150. Because mechanical counting mechanism 301 is compact, a relatively large portion of magazine 150 can be devoted to reservoir 152, and a relatively large amount of propellant can be stored. For example, example magazine 150 may store enough carbon dioxide to power up to 30, 40, 50, 60, 75, 90, or more simulated firings. To "reload" simulated pistol 100, it may be necessary only to remove magazine 150, rotate dial 153 to a desired number of rounds, depress lockback plunger 406, and reinsert magazine 150 back into simulate pistol 100. Any number of rounds can be "loaded" into magazine in this way, from a single round to the simulated capacity of magazine 150.

As is most easily seen in FIG. 4, when pin 403 has rotated past its engagement with locking shaft 404 and lockback plunger 406 is forcibly depressed back into magazine 150, locking spring 411 forces locking shaft 404 into recess 405 of lockback plunger 406. In some embodiments, lockback plunger 406 may be automatically depressed when magazine 150 is inserted into simulated pistol 100.

If a more realistic training scenario is desired, reloading of simulated pistol 100 would be accomplished by removing magazine 150 from simulated pistol 100 and replacing it with another similar magazine, even if magazine 150 still contains enough propellant for firing more simulated rounds. Spent magazines can be recharged with propellant at a refilling station, for example when the training exercise is finished. Because of the large propellant capacity, such refills may be required less frequently than with other simulated weapons.

Figure 6:
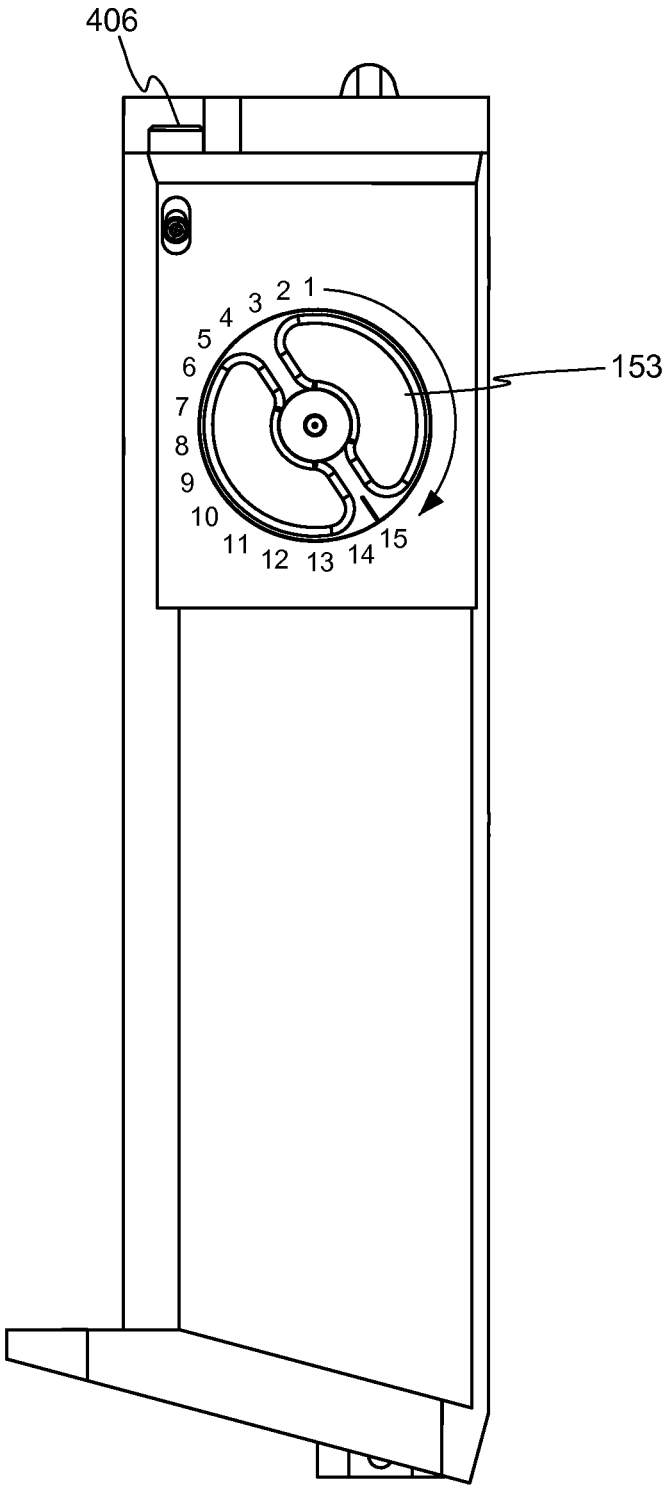
FIG. 6 illustrates another view of the example magazine of FIG. 1.

In some embodiments, the number of rounds in magazine 150 is adjustable before loading magazine 150 into simulated pistol 100. FIG. 6 illustrates that in example magazine 150, the number of simulated rounds can be selected by rotating dial 153 (and consequently ratchet wheel 302) in the direction shown to the desired number of rounds, from one to 15. In some embodiments, the maximum number of simulated rounds may be larger or smaller than 15. In conjunction with setting the number of rounds, lockback plunger 406 may be manually reset. In other embodiments, lockback plunger 406 may reset upon insertion of magazine 150 into simulated pistol 100.

Simulated pistol 100 may be reloaded in at least two ways. In a first reloading scenario, the user will insert a new magazine while slide 101 is in the forward position, as shown in FIG. 1. This may occur, for example, at the beginning of a training session. When magazine 150 is inserted with slide 101 in the forward position, action lever 306 will contact the low point of ramp 307, near the rear of slide 101. This position is illustrated in FIGS. 1 and 3B. No motion is imparted to ratchet wheel 302. The user would then manually actuate slide, pulling it rearward to the position shown in FIGS. 2 and 3C, and allowing it to return to its forward position. This cycle decrements counting mechanism 301 by one (moving ratchet wheel 302 by one tooth), and loads one simulated round into simulated pistol 100. This accurately mimics the behavior of an actual pistol, in which manually actuating the slide loads one cartridge from the magazine into the chamber of the weapon.

In a second reloading scenario, a fresh magazine 150 is inserted into simulated pistol 100 while slide 101 is in the locked back position. This may occur, for example, after the previous magazine has been emptied by firing all of its simulated rounds, and slide 101 has automatically locked back as a result as described above. When magazine 150 is inserted in this position, action lever 306 will contact the high point of ramp 307, depressing actuation rod 305 into the position shown in FIG. 3C. This rotates ratchet wheel 302 by one tooth. When slide 101 is manually released and allowed to return to its forward position, the first simulated round is loaded. This also mimics the behavior of an actual weapon.

In either scenario, the counter will indicate one round fewer that its original setting, mimicking the behavior of an actual weapon in which transferring one cartridge to the chamber of the weapon reduces the number of rounds in the magazine by one.

The invention has now been described in detail for the purposes of clarity and understanding. However, it will be appreciated that certain changes and modifications may be practiced within the scope of the appended claims. It is to be understood that all workable combinations of the features and capabilities described herein are also considered to be disclosed.

What is claimed is:

1. A magazine for a simulated pistol, the magazine comprising:

a mechanical counting mechanism that incrementally advances upon a firing of the simulated pistol, wherein the mechanical counting mechanism includes a ratchet wheel that incrementally rotates upon each firing of the simulated pistol, a dial coupled to the ratchet wheel by a shaft such that the dial rotates with the ratchet wheel, and a pin on the dial;

a lockback plunger; and a locking shaft configured to removably engage the lockback plunger to hold the lockback plunger within the magazine;

wherein the pin on the dial is configured to engage the locking shaft and draw the locking shaft out of engagement with the lockback plunger when the mechanical counting mechanism reaches a state indicating that all simulated rounds have been fired from the simulated pistol, releasing the lockback plunger.

2. The magazine for a simulated pistol as recited in claim 1, wherein the mechanical counting mechanism includes a dual pawl counting mechanism.

3. The magazine for a simulated pistol as recited in claim 1, wherein advancement of the mechanical counting mechanism is driven from the recoil of a slide of the simulated pistol.

4. The magazine for a simulated pistol as recited in claim 3, further comprising an actuation rod driven directly or indirectly by a ramp in the slide of the simulated pistol to actuate the mechanical counting mechanism.

5. The magazine for a simulated pistol as recited in claim 1, further comprising a reservoir holding a pressurized propellant that provides energy for operating the simulated pistol.

6. The magazine for a simulated pistol as recited in claim 5, wherein the reservoir holds carbon dioxide at sufficient pressure to liquefy the carbon dioxide.

7. The magazine for a simulated pistol as recited in claim 5, wherein the reservoir holds sufficient propellant to fire at least 30 simulated rounds from the simulated pistol.

8. The magazine for a simulated pistol as recited in claim 5, wherein the reservoir holds sufficient propellant to fire at least 50 simulated rounds from the simulated pistol.

9. A magazine for a simulated pistol, comprising:

a mechanical counting mechanism that incrementally advances upon a firing of the simulated pistol; and a lockback element that is actuated by the mechanical counting mechanism when the mechanical counting mechanism reaches a state indicating that all simulated rounds have been fired from the simulated pistol;

wherein:

the lockback element is a lockback plunger that is released when the mechanical counting mechanism reaches the state indicating that all simulated rounds have been fired from the simulated pistol;

the magazine further comprises a locking shaft configured to engage the lockback plunger to hold the lockback plunger within the magazine; and the mechanical counting mechanism further includes a ratchet wheel that incrementally rotates upon each firing of the simulated pistol, a dial coupled to the ratchet wheel by a shaft such that the dial rotates with the ratchet wheel, and a pin on the dial configured to engage the locking shaft and draw the locking shaft out of engagement with the lockback plunger when the counting mechanism reaches the state indicating that all simulated rounds have been fired from the simulated pistol, releasing the lockback plunger.

10. The magazine for a simulated pistol as recited in claim 1, wherein the mechanical counting mechanism is settable to indicate a number of simulated rounds in the magazine.

11. The magazine for a simulated pistol as recited in claim 10, wherein the mechanical counting mechanism is settable by rotating the ratchet wheel to a particular rotational position to indicate number of simulated rounds in the magazine.

12. The magazine for a simulated pistol as recited in claim 1, wherein:

the lockback plunger is positioned to actuate a lockback lever of the simulated pistol when the lockback plunger is released.

13. A simulated weapon, comprising:

a slide;

a magazine;

a mechanical counting mechanism, wherein the mechanical counting mechanism incrementally advances upon a firing of the simulated pistol, and wherein the mechanical counting mechanism includes a ratchet wheel that incrementally rotates upon each firing of the simulated weapon, a dial coupled to the ratchet wheel by a shaft such that the dial rotates with the ratchet wheel, and a pin on the dial;

a lockback plunger; and a locking shaft configured to removably engage the lockback plunger to hold the lockback plunger within the magazine:

wherein the pin on the dial is configured to engage the locking shaft and draw the locking shaft out of engagement with the lockback plunger when the mechanical counting mechanism reaches a state indicating that all simulated rounds have been fired from the simulated weapon, releasing the lockback plunger to engage the slide of the simulated weapon and cause the slide of the simulated weapon to lock back.

14. The simulated weapon of claim 13, wherein the simulated weapon is a simulated pistol.

15. The simulated weapon of claim 13, wherein the simulated weapon is untethered.

16. The simulated weapon of claim 13, wherein the simulated weapon is made by modifying an actual weapon.

17. The simulated weapon of claim 13, wherein the mechanical counting mechanism is a dual pawl mechanism actuated by motion of the slide.

18. The magazine for a simulated pistol as recited in claim 1, wherein the lockback plunger defines a recess into which the locking shaft protrudes to engage the lockback plunger.

19. The magazine for a simulated pistol as recited in claim 9, wherein the lockback plunger defines a recess into which the locking shaft protrudes to engage the lockback plunger.

20. The simulated weapon of claim 13, wherein the lockback plunger defines a recess into which the locking shaft protrudes to engage the lockback plunger.

* * * * *